United States Patent [19]
Morooka et al.
[11] 4,240,147
[45] Dec. 16, 1980

[54] GAUGE CONTROL METHOD AND SYSTEM FOR ROLLING MILL

[75] Inventors: Yasuo Morooka; Shinya Tanifuji; Shigemichi Matsuka, all of Hitachi, Japan

[73] Assignee: Hitachi, Ltd., Japan

[21] Appl. No.: 913,455

[22] Filed: Jun. 7, 1978

Related U.S. Application Data

[63] Continuation-in-part of Ser. No. 780,788, Mar. 24, 1977, abandoned.

[30] Foreign Application Priority Data

Mar. 26, 1976 [JP] Japan ..... 51-33294

[51] Int. Cl.[3] ..... G06F 15/46; B21B 37/12

[52] U.S. Cl. ..... 364/472; 72/8; 364/105

[58] Field of Search ..... 72/8-16; 364/472, 476, 107

[56] References Cited

U.S. PATENT DOCUMENTS

| | | | |
|---|---|---|---|
| 3,600,920 | 8/1971 | Smith, Jr. | 72/8 |
| 3,624,369 | 11/1971 | Kip, Jr. | 364/472 |
| 3,694,636 | 9/1972 | Smith, Jr. | 364/472 |
| 3,787,667 | 1/1974 | King et al. | 364/472 |
| 3,934,438 | 1/1976 | Arimura et al. | 72/9 |
| 4,030,326 | 6/1977 | Morooka et al. | 72/8 |
| 4,087,859 | 2/1978 | Anbe | 364/472 |

FOREIGN PATENT DOCUMENTS 2713301 10/1977 Fed. Rep. of Germany ..... 364/472

*Primary Examiner*—Felix D. Gruber
*Attorney, Agent, or Firm*—Craig and Antonelli

[57] ABSTRACT

The present invention provides a method and a system for controlling strip thickness in rolling mill, especially adapted in the case where material is rolled by a tandem rolling mill. According to the present invention, the change in the strip thickness from one sampling epoch to another is calculated on the basis of two sampling values, i.e. strip thickness and strip thickness deviation, at the entrance side of a mill stand; the press-down speed and the workpiece tension are determined according to such a condition as to minimize the calculated change during the sampling period; and the press-down speed and the interstand tension are regulated by the thus determined mill speed and tension when a certain portion of the strip reaches the stand bite of the next mill stand.

13 Claims, 12 Drawing Figures

GAUGE CONTROL METHOD AND SYSTEM FOR ROLLING MILL

CROSS-REFERENCES TO RELATED APPLICATIONS

This is a continuation-in-part application of co-pending U.S. patent application Ser. No. 780,788 filed Mar. 24, 1977, now abandoned.

BACKGROUND OF THE INVENTION

1. Field of the Invention

The present invention relates to a technique for controlling the strip thickness in a rolling mill, and more particularly to a method and a system for controlling the strip thickness, which aims at reducing to an appreciable extent the gauge deviation of the strip at the head and tail ends of the strip inherent to the prior art method and system.

2. Description of the Prior Art

In conventional methods for controlling the strip thickness in a rolling mill, the thickness deviation of the delivered or outgoing strip is detected by the gauge meter method, the mass flow method, or the thickness meter method and the screwdown or press-down position of the work roll and/or the speed of the work rolls are so controlled that the thickness deviation may be reduced to zero.

These methods, using feedback control, have a drawback that the accurate control of strip thickness is difficult due to the delays in the detection of the strip thickness and in the control operation of the control system. As one of the conventional methods for eliminating such a drawback, there has been proposed a strip feed-forward control in which the strip thickness deviation is detected at the entrance side of the rolling mill, the thickness of the delivered strip is estimated on the basis of the strip thickness deviation at the entrance side, and the press-down position of the work rolls and/or the speed of the work rolls are so controlled as to reduce the estimated delivered strip thickness deviation to zero.

A typical example of the feed-forward control will be described. The output signal of the thickness meter provided at the entrance side of a stand of a rolling mill is delayed by a time $T_L$, and press-down position of the work roll is corrected. Here, the time $T_L$ is given by the following expression $$T_L = L/v \quad (1),$$

where L is the distance from the position of the thickness meter to the work roll of the mill stand, and v is the velocity of the strip. It is considered to make a point of detection coincide with the point of control by delaying the moment of correction in the press-down of the work roll by the feed time required for the point of detection to shift from the position of the thickness meter to the work roll. Such a technique is disclosed, for example, in Japanese Patent Publication No. 25509/63. By further developing this technique, it is known to control the interstand tension when the point of detection reaches a predetermined mill stand. The method for controlling the interstand tension is disclosed, for example, in Japanese Patent Publication No. 7140/76 (based on U.S. patent application Ser. No. 92,349). Since the delay in the operation of the press-down apparatus is greater than the delay in the rolling speed, the above method employs a means for applying to the press-down apparatus a press-down position correcting signal based on the detected strip thickness by shortening the delay time $T_L$ by the delay $T_S$ in response. Moreover, since the press-down apparatus has a delay in response, the strip thickness control using tension (velocity) control which has a more rapid response, and like control methods have been proposed and put into practice. It is therefore clear that if these methods are combined with the feedback method, the accuracy in strip thickness can be much improved.

However, concerning the off-gauge portions of the strip at the head and tail ends thereof which causes a problem in the control of strip thickness, the lengths of the off-gauge portions are considerably reduced according to the control methods as described above, but at present the methods can not be said to be satisfactory. A certain steel producing factory reported that steel strips which were off-gauge portions and which could not be used as commercial product, amount to 450 tons per month and that the amount of the off-gauge portions was about 0.6% of the total amount of production by the factory. It is therefore easily understood that the reduction of the useless amount results in various improvements such as the reductions of production cost, energy consumption etc. The inventors, therefore, determined why the off-gauge portions were generated and have found a problem inherent to the prior art feed-forward control. The problem will be described below, with the above-described feed-forward control for correcting the press-down position taken as an example. Recently, the strip thickness control usually uses a computer. The thicknesses (strip thickness) or thickness deviations are taken into the computer at a predetermined sampling rate so that the degree of press-down according to the thickness or thickness deviation is determined to control the press-down position. The delay in the response of the press-down apparatus can be compensated to a certain extent, as described above, by advancing the timing of press-down control by the time of delay in the operation of the press-down apparatus and therefore it is assumed for simplicity that the press-down apparatus has no delay in response. Now, the strip thickness is detected at a time, the correction amount for the press-down position according to the detected thickness, and the press-down apparatus is manipulated in accordance with the correction amount. If the operation of the press-down apparatus takes place when the detected portion reaches the mill stand, the detected portion can be controlled very accurately. However, the points to be subjected to detection lie at discrete positions along the length of the strip and the control system is constructed on the assumption that the strip thickness is constant during sampling periods. Namely, since the strip thickness to be detected is constant during the sampling period, control is made under the condition that there is a stepwise variation in strip thickness. However, the actual variation in the strip thickness is not stepwise but continuous. The sampling value usually varies from one sampling epoch to another so that the press-down operation for one sampling value is often opposite in direction to that for another. In this type of control, the fluctuation of the control amount due to the delay in response or the response characteristic will be considerable in a practical rolling operation. It is clear that if control corresponding to the case where there is no fluctuation of strip thickness over a certain interval (or period), is made for the case where the strip thickness varies continuously, then such a control will be insufficient. With such a conventional strip thickness control, it is difficult to obtain the on-gauge thickness in a series of rolling processes: threading-acceleration-normal rolling-deceleration-drawing, except in the portion under the normal rolling where tension, rolling speed and the thickness of oil film between roll and strip are constant. Accordingly, it is easily understood that off-gauge portions are generated at the head end of the strip in "threading and acceleration" steps and at the tail end of the strip in "deceleration and drawing" steps.

The present invention, made to correct the deficiencies described above, aims at providing a novel method and a system for controlling the strip thickness in a rolling mill, according to which the length or the rate of off-gauge portions at the ends of strip can be minimized.

According to one feature of the present invention, the thickness deviation of delivered strip can be minimized by the control taking in consideration the change with time in strip thickness deviation or dynamic characteristic.

Other features and objects of the present invention will become obvious from the following description.

DESCRIPTION OF THE PREFERRED EMBODIMENT

Prior to the explanation of an embodiment of the present invention, the principle of the present invention will be described for a better understanding. The conventional strip thickness control for the fluctuation of strip thickness occurring the period of sampling is not satisfactory so that the combination of the feedback control with the feed-forward control still cannot attain a satisfactory accuracy.

Figure 1:
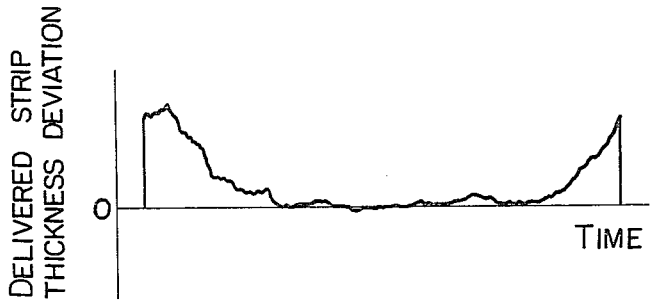
FIG. 1 illustrates the relationship between the rolling time and the strip thickness deviation.

FIG. 1 illustrates the variation with time of the thickness of the strip delivered from a cold or hot rolling mill employing the conventional strip thickness control method. As seen in FIG. 1, at the head and tail ends of the strip the strip thickness deviation changes exponentially due to the generation of tension in the entry of the strip into the first mill stand, the vanishing of tension at the delivery of the last mill stand, the change in the hardness of the strip material and the characteristics of the rolling mill and the control system.

The present invention is based on the knowledge that the delivered strip thickness deviation varies with time in accordance with the changes with time in the incoming strip thickness deviation, the press-down speed of the work roll and the interstand tension and that the change in the delivered strip thickness deviation is proportional to time $\tau$ during a very short sampling period (e.g. several tens of milliseconds) and therefore given by a linear expression. The fact that the change in the delivered strip thickness deviation can be linearly formulated, is worthy of attention since in such a case the optimal control by the direct digital control (DDC) using a computer can be employed. As suggested before, the gist of the present invention is that the strip thickness deviation is proportional to time $\tau$ within sampling period and given by a linear expression. The most important point will be described below. With respect to one stand of a mill, let the incoming strip thickness deviation, the press-down speed of the work roll during sampling period and the interstand tension deviation from a reference value be denoted respectively by $\Delta H(\tau)$, $v_s$ and $\Delta t_p$. Then, the delivered strip thickness deviation $\Delta h(\tau)$ is expressed as follows.

$$\Delta h(\tau) = \frac{\partial h}{\partial H} \cdot \frac{d\Delta H(\tau)}{d\tau}(\tau - kT) + \frac{\partial h}{\partial s} \cdot v_s(\tau - kT) + \frac{\partial h}{\partial t_f} \cdot \Delta t_{fp} + \frac{\partial h}{\partial t_b} \cdot \Delta t_{bp} + \Delta h(kT) \quad (2)$$

Where $\tau$ is the time, $\Delta H$ the incoming strip thickness deviation, T the sampling period, S the press-down position, $\Delta t_{fp}$ the forward tension deviation, $\Delta t_{bp}$ the backward tension deviation and $\Delta h(kT)$ the delivered strip thickness deviation at a sampling period kT. The rate of change in the delivered strip thickness with respect to the incoming strip thickness is designated by $\partial h/\partial H$ and it is usually a constant determined uniquely by the hardness of the strip material and the press-down amount. Symbol $\partial h/\partial s$ is the partial differential coefficient of the delivered strip thickness with respect to the press-down position, and $\partial h/\partial t_f$ and $\partial h/\partial t_b$ the partial differential coefficients of the delivered strip thickness with respect to the forward and backward tensions. The expression (2) above is the dynamic characteristic formula used in the present invention. In (2), the interstand tension may be replaced by the interstand roll speed deviation with the substantially same effects. According to a preferred embodiment of the present invention described later, the stands of the rolling mill are provided with expressions like (2) and the control variable such as the press-down position, the motor speed and the tension of the strip, associated with each stand can be selected in accordance with the desired mode of control.

The dynamic characteristic formula like (2), written down for the i-th mill stand is such that $$\Delta h_i(\tau) = \left(\frac{\partial h}{\partial H}\right)_i \cdot \frac{d\Delta H_i(\tau)}{d\tau} \cdot (\tau - kT) \quad (3)$$

-continued $$+ \eta_{si}\left(\frac{\partial h}{\partial s}\right)_i \cdot v_{si}(\tau - kT)$$
$$+ \eta_{ti-1}\left(\frac{\partial h}{\partial t_b}\right)_i \cdot \Delta t_{pi-1} + \eta_{ti}\left(\frac{\partial h}{\partial t_f}\right)_i \Delta t_{pi}$$
$$+ \Delta h_i(kT)$$

where the subscripts i and i−1 refer to the variables associated with the i-th and (i+1)th stands; $n_{si}$, $n_{ti}$ and $n_{ti-1}$ are the mode coefficients each taking a value "1" or "0" in accordance with desired mode of control; $\Delta t_{pi-1}$ the backward tension with respect to the i-th stand (i.e. the forward tension with respect to the (i−1)th stand); and $\Delta t_{pi}$ the forward tension with respect to the i-th stand.

According to one aspect of the invention, values of the press-down speed $v_{si}$, the forward tension variation $\Delta t_{pi}$ and so forth at which the delivered strip thickness deviation at the individual stands as determined from the equation (3) may satisfy predetermined conditions are first determined, whereby the screw-down or press-down apparatus, roll speed and the like are controlled on the basis of these values as obtained. As the predetermined conditions described above, there may be enumerated a variety or type of material to be rolled, strip thickness desired for the finished product, shape or dimension required for the product, performance characteristics unique to the mill stands as employed or the like which can be empirically determined in consideration of the imposed rolling conditions and may be represented generally by an evaluating function J described hereinafter.

For example, under certain rolling conditions, control is desirably to be made such that the strip thickness variation $\Delta h(\tau)$ as measured during each sampling period $\tau$ may become minimum. In such a case, the evaluating function J for which the integral of $\Delta h(\tau)$ becomes minimum can be used. However, during a certain sampling period the strip thickness deviation is not only positive, but usually varies over the positive and the negative values. Consequently, it is not always preferable to perform control in such a manner that the definite integral of $\Delta h(\tau)$ is minimum.

Therefore, considering the posibility of the strip thickness deviation varying over both positive and negative values, the inventors have chosen an evaluating function J such that the sum of the squares of the sampled values of the delivered strip thickness deviation at each mill stand is minimized over a sampling period. Namely, $$J = \underset{v_{si},\Delta t_{pi}}{\text{Min}} \int_{kT}^{(k+1)T} \{\sum_{i=1}^{n} \Delta h_i^2(\tau)\} d\tau \tag{4}$$

where n indicates the number of stands, that is, n=5 for a five-stand rolling mill. There are also other evaluating functions adoptable in the present invention, in which the absolute sum of or the sum of the squares of the sampled values of interstand tension, the changes in the press-down position and press-down speed of work roll is minimized. Namely, such evaluating functions as given below may be used.

$$J = \underset{v_{si},\Delta t_{pi}}{\text{Min}} \int_{kT}^{(k+1)T} \Sigma \{\alpha \Delta h_i^2(\tau) + \beta \Delta t_{fpi}^2(\tau) + \gamma \Delta t_{bpi}^2(\tau) + \delta v_{si}^2(\tau) + \epsilon \Delta v_i^2(\tau)\} d\tau \tag{5}$$

-continued $$J = \underset{v_{si},\Delta t_{pi}}{\text{Min}} \int_{kT}^{(k+1)T} \Sigma \{\alpha' |\Delta h_i(\tau)| + \beta' |\Delta t_{fpi}(\tau)| = \gamma' |\Delta t_{bpi}(\tau)| + \delta' |v_{si}^2(\tau)| + \epsilon' |\Delta v_i(\tau)|\} d\tau \tag{6}$$

where $\alpha$, $\beta$, $\gamma$, $\delta$, $\epsilon$, $\alpha'$, $\beta'$, $\gamma'$, $\delta'$ and $\epsilon'$ are weighting coefficients each taking a value of 0 to 1, and $\Delta v_i(\tau)$ is the change in the roll speed of the i-th stand at the instant $\tau$.

As hereinbefore described, it can be empirically determined in dependence on the imposed rolling conditions which type of the evaluating functions is to be adopted. The following description is made on the assumption that the evaluating function as given by the expression (4) is employed. However, it will be readily appreciated that the method of the invention can be equally applied to the cases where other evaluating functions such as an integral of absolute value of the strip thickness deviation are adopted.

In the case of the illustrated embodiment of the invention, the press-down speed $V_{si}$ and the forward tension variation $\Delta t_{pi}$ are employed as the control quantities to have the strip thickness deviation satisfying the evaluating function J given by the expression (4). As will be seen from the expressions (3) and (4), the values of $V_{si}$ and $\Delta t_{pi}$ for satisfying the evaluating function J may be determined through solution of the following linear equations in case of a five-stand tandem rolling mill.

$$\eta_{s1}\left[\frac{\eta_{s1}}{3} \cdot \left(\frac{\partial h}{\partial s}\right)_1 \cdot T \cdot v_{s1} + \frac{\eta_{t1}}{2} \cdot \left(\frac{\partial h}{\partial t_f}\right)_1 \cdot \Delta t_{p1} + \tfrac{1}{2} \cdot \Delta h_1(kT) + \tfrac{1}{3} \cdot \left(\frac{\partial h}{\partial H}\right)_1 \cdot \left(\frac{\partial H}{\partial \tau}\right)_1 \cdot T\right] = 0 \tag{7}$$

$$\eta_{s2}\left[\frac{\eta_{s2}}{3} \cdot \left(\frac{\partial h}{\partial s}\right)_2 \cdot T \cdot v_{s2} + \frac{\eta_{t1}}{2} \cdot \left(\frac{\partial h}{\partial t_b}\right)_2 \cdot \Delta t_{p1} + \frac{\eta_{t2}}{2} \left(\frac{\partial h}{\partial t_f}\right)_2 \cdot \Delta t_{p2} + \tfrac{1}{2} \cdot \Delta h_2(kT) + \tfrac{1}{3} \cdot \left(\frac{\partial h}{\partial H}\right)_2 \cdot \left(\frac{\partial H}{\partial \tau}\right)_2 \cdot T\right] = 0 \tag{8}$$

$$\eta_{s3}\left[\frac{\eta_{s3}}{3} \cdot \left(\frac{\partial h}{\partial s}\right)_3 \cdot T \cdot v_{s3} + \frac{\eta_{t2}}{2} \cdot \left(\frac{\partial h}{\partial t_b}\right)_3 \cdot \Delta t_{p2} + \frac{\eta_{t3}}{2} \cdot \left(\frac{\partial h}{\partial t_f}\right)_3 \cdot \Delta t_{p3} + \tfrac{1}{2} \cdot \Delta h_3(kT) + \tfrac{1}{3} \cdot \left(\frac{\partial h}{\partial H}\right)_3 \cdot \left(\frac{\partial H}{\partial \tau}\right)_3 \cdot T\right] = 0 \tag{9}$$

$$\eta_{s4}\left[\frac{\eta_{s4}}{3} \cdot \left(\frac{\partial h}{\partial s}\right)_4 \cdot T \cdot v_{s4} + \frac{\eta_{t3}}{2} \cdot \left(\frac{\partial h}{\partial t_b}\right)_4 \cdot \Delta t_{p3} + \frac{\eta_{t4}}{2} \cdot \left(\frac{\partial h}{\partial t_f}\right)_4 \cdot \Delta t_{p4} + \tfrac{1}{2} \cdot \Delta h_4(kT) + \tfrac{1}{3} \cdot \left(\frac{\partial h}{\partial H}\right)_4 \cdot \left(\frac{\partial H}{\partial \tau}\right)_4 \cdot T\right] = 0 \tag{10}$$

$$\eta_{s5}\left[\frac{\eta_{s5}}{3} \cdot \left(\frac{\partial h}{\partial s}\right)_5 \cdot T \cdot v_{s5} + \frac{\eta_{t4}}{2} \cdot \left(\frac{\partial h}{\partial t_b}\right)_5 \cdot \Delta t_{p4} + \tfrac{1}{2} \cdot \Delta h_5(kT) + \tfrac{1}{3} \cdot \left(\frac{\partial h}{\partial H}\right)_5 \cdot \left(\frac{\partial H}{\partial \tau}\right)_5 \cdot T\right] = 0 \tag{11}$$

$$\eta_{t1}\left[\left(\frac{\partial h}{\partial t_f}\right)_1 \cdot \left\{\frac{\eta_{s1}}{2} \cdot \left(\frac{\partial h}{\partial s}\right)_1 \cdot T \cdot v_{s1} + \eta_{t1} \cdot \left(\frac{\partial h}{\partial t_f}\right)_1 \cdot \Delta t_{p1} + \Delta h_1(kT) + \tfrac{1}{2} \cdot \left(\frac{\partial h}{\partial H}\right)_1 \cdot \left(\frac{\partial H}{\partial \tau}\right)_1 \cdot T\right\} + \left(\frac{\partial h}{\partial t_b}\right)_2 \cdot \left\{\frac{\eta_{s2}}{2} \cdot \left(\frac{\partial h}{\partial s}\right)_2 \cdot T \cdot v_{s2} + \eta_{t1}\left(\frac{\partial h}{\partial t_b}\right)_2 \cdot \Delta t_{p1} + \eta_{t2} \cdot \left(\frac{\partial h}{\partial t_f}\right)_2 \cdot \Delta t_{p2} + \Delta h_2(kT) + \tfrac{1}{2} \cdot \left(\frac{\partial h}{\partial H}\right)_2 \cdot \left(\frac{\partial H}{\partial \tau}\right)_2 \cdot T\right\}\right] = 0 \tag{12}$$

$$\eta_{t2}\left[\left(\frac{\partial h}{\partial t_f}\right)_2 \cdot \left\{\frac{\eta_{s2}}{2} \cdot \left(\frac{\partial h}{\partial s}\right)_2 \cdot T \cdot v_{s2} \cdot \eta_{t1}\left(\frac{\partial h}{\partial t_b}\right)_2 \cdot \Delta t_{p1} + \eta_{t2} \cdot \left(\frac{\partial h}{\partial t_f}\right)_2 \cdot \Delta t_{p2} + \Delta h_2(kT)\right.\right. \tag{13}$$

-continued $$+ \frac{1}{2} \cdot \left(\frac{\partial h}{\partial H}\right)_2 \cdot \left(\frac{\partial H}{\partial \tau}\right)_2 \cdot T\}$$

$$+ \left(\frac{\partial h}{\partial t_b}\right)_3 \cdot \{\frac{\eta_{s3}}{2} \cdot \left(\frac{\partial h}{\partial s}\right)_3 \cdot T \cdot v_{s3} + \eta_{t2} \cdot \left(\frac{\partial h}{\partial t_b}\right)_3 \cdot \Delta t_{p2}$$

$$+ \eta_{t3} \cdot \left(\frac{\partial h}{\partial t_f}\right)_3 \cdot \Delta t_{p3} + \Delta h_3(kT)$$

$$+ \frac{1}{2} \cdot \left(\frac{\partial h}{\partial H}\right)_3 \cdot \left(\frac{\partial H}{\partial \tau}\right)_3 \cdot T\}] = 0$$

$$\eta_{t3}[\left(\frac{\partial h}{\partial t_f}\right)_3 \cdot \{\frac{\eta_{s3}}{2} \cdot \left(\frac{\partial h}{\partial s}\right)_3 \cdot T \cdot v_{s3} \tag{14}$$

$$+ \eta_{t2} \cdot \left(\frac{\partial h}{\partial t_b}\right)_3 \cdot \Delta t_{p2} + \eta_{t3} \cdot \left(\frac{\partial h}{\partial t_f}\right)_3 \cdot \Delta t_{p3} + \Delta h_3(kT)$$

$$+ \frac{1}{2} \cdot \left(\frac{\partial h}{\partial H}\right)_3 \cdot \left(\frac{\partial H}{\partial \tau}\right)_3 \cdot T\}$$

$$+ \left(\frac{\partial h}{\partial t_b}\right)_4 \cdot \{\frac{\eta_{s4}}{2} \cdot \left(\frac{\partial h}{\partial s}\right)_4 \cdot T \cdot v_{s4} + \eta_{t3}\left(\frac{\partial h}{\partial t_b}\right)_4 \cdot \Delta t_{p3}$$

$$+ \eta_{t4}\left(\frac{\partial h}{\partial t_f}\right)_4 \cdot \Delta t_{p4} + \Delta h_4(kT)$$

$$+ \frac{1}{2} \cdot \left(\frac{\partial h}{\partial H}\right)_4 \cdot \left(\frac{\partial H}{\partial \tau}\right)_4 \cdot T\}] = 0$$

$$\eta_{t4}[\left(\frac{\partial h}{\partial t_f}\right)_4 \cdot \{\frac{\eta_{s4}}{2} \cdot \left(\frac{\partial h}{\partial s}\right)_4 \cdot T \cdot v_{s4} + \eta_{t3} \cdot \left(\frac{\partial h}{\partial t_b}\right)_4 \cdot \Delta t_{p3} \tag{15}$$

$$+ \eta_{t4} \cdot \left(\frac{\partial h}{\partial t_f}\right)_4 \cdot \Delta t_{p4} + \Delta h_4(kT)$$

$$+ \frac{1}{2} \cdot \left(\frac{\partial h}{\partial H}\right)_4 \cdot \left(\frac{\partial H}{\partial \tau}\right)_4 \cdot T\}$$

$$+ \frac{\partial h}{\partial t_b})_5 \{\frac{\eta_{s5}}{2} \cdot \left(\frac{\partial h}{\partial s}\right)_5 \cdot T \cdot v_{s5}$$

$$+ \eta_{t4} \cdot \left(\frac{\partial h}{\partial t_b}\right)_5 \cdot \Delta t_{p4} + \Delta h_5(kT)$$

$$+ \frac{1}{2} \cdot \left(\frac{\partial h}{\partial H}\right)_5 \cdot \left(\frac{\partial H}{\partial \tau}\right)_5 \cdot T\}] = 0$$

In brief, the values of $V_{si}$ and $\Delta t_{pi}$ which satisfy the evaluating function J given by the expression (4) are determined from the above equations (7) to (15) and the press-down speed as well as the tension at the individual mill stands are controlled on the basis of these values thereby to perform a desired thickness control.

In other words, the invention teaches basically that the delivered strip thickness deviation is calculated from the equation (3) on the basis of the measurement values of the control quantities described above as sampled during respective sampling periods and subsequently the values of $V_{si}$ and $\Delta t_{pi}$ are arithmetically determined with the aid of the equations (7) to (15) on the basis of the sampled values and the delivered thickness deviation as calculated from the equation (3). The results thus obtained are then utilized for controlling the press-down speed and the tension. Accordingly, it is self-explanatory that the delivered thickness deviation as obtained through the above control does satisfy the evaluating function J given by the expression (4). In conjunction with the equations (7) to (15), the terms $\eta_{si}$ and $\eta_{ti}$ may take either "1" or "0". The selection of such values may be empirically determined so as to attain the optimum control mode in consideration of the practically imposed rolling conditions as described hereinbefore. The present invention will now be described by way of a preferred embodiment.

Figure 2:
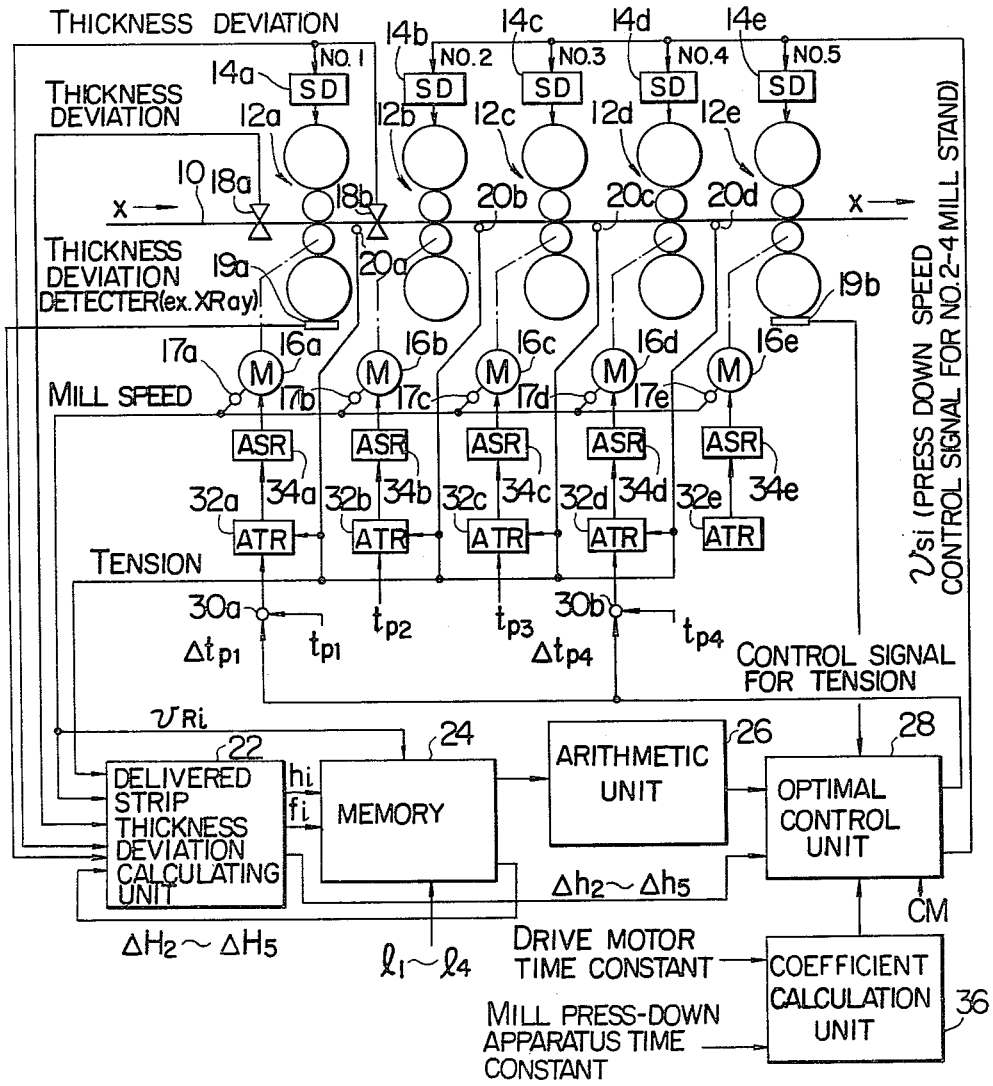
FIG. 2 shows in block diagram an embodiment of the present invention.

FIG. 2 shows in block diagram an embodiment in which the present invention is applied to a five-stand tandem cold rolling mill. In FIG. 2, a cold rolling mill comprises No. 1–No. 5 mill stands 12a–12e arranged in tandem for rolling a strip 10 fed in the X-direction. The work rolls of the respective stands are driven by drive motors (M) 16a–16e and shifted down by press-down controllers 14a–14e. Speed detectors 17a–17e derive output signals proportional to the rotational speeds of the motors 16a–16e, respectively. Thickness detectors 18a and 18b are provided at the entrance sides of the No. 1 and No. 2 stands 12a and 12b, and interstand tension detectors 20a–20d are disposed between the stands. A delivered strip thickness deviation calculating unit 22 serves to calculate the delivered strip thickness deviations at the delivery sides of the respective stands. The unit 22 receives the outputs of the thickness detectors 18a and 18b, the outputs of the speed detectors 17a–17e and the outputs of the interstand tension detectors 20a–20d, calculates the delivered strip thicknesses out of the respective stands, and delivers the deviations of the thicknesses from a reference value. A memory unit 24 receives the output of the delivered strip thickness deviation calculating unit 22 and the roll speed outputs, i.e. the outputs representing the speeds of work rolls of the respective stands and stores the delivered strip thickness deviations out of the respective mill stands while the strip is being transferred between the mill stands 12a and 12b, 12b and 12c, 12c and 12d, and 12d and 12e. The stored values in the memory unit 24 are delivered as the incoming strip thickness deviations to the delivered strip thickness deviation calculating unit 22. The memory unit 24 also delivers the last two of the stored values (i.e. the incoming strip thickness deviation $\Delta H_{i+1}$ and the corresponding deviation at the succeeding sampling time) to an arithmetic unit 26 for calculating the differential ratio of the incoming strip thickness deviation to time, i.e. $(d\Delta H/d\tau)$, for serving as the change with time in the incoming strip thickness deviation, supplied to the next stage. The arithmetic unit 26 subjects the difference between the two received stored values to division so as to calculate the change with time in the incoming strip thickness deviation (i.e. the rate of change with time in the incoming strip thickness) and delivers the calculated output to an optimal control unit 28. The calculating formula associated with the arithmetic unit 26 is therefore $[\Delta H(\tau)-\Delta H(\tau-T)]/T$. The optimal control unit 28 receives the outputs of the units 22 and 26 and calculates the optimal control amounts respectively for the press-down speed $v_{si}$ and the change in tension $\Delta t_{pi}$ in accordance with the above expressions (7)–(15) and a predetermined signal CM for giving a desired mode of control, and the optimal control amounts are delivered to a press-down control system and a tension control system. The various constants required for the arithmetic operations in the unit 28 are available from the output of the coefficient calculating unit 36 before the initiation of the rolling operation.

The outputs of the optimal control unit 28, i.e. the change in tension, is used to correct the preset values of tension $t_{p1}$ and $t_{p4}$ in adders 30a and 30b, respectively. Automatic tension regulators (ATR) 32a–32e, the ATR's 32a–32d respectively receive the outputs of tension detectors 20a–20d and also receive the outputs of the adders 30a and 30b and the preset values of tension $t_{p2}$ and $t_{p3}$ to deliver a control signal for reducing to zero the difference between an arbitrary two of the above outputs. Automatic speed regulators (ASR) 34a–34e, which respectively receive the outputs of the ATR's 32a–32e, control the rotational speeds of drive motors 16a–16e respectively in accordance with the outputs. The press-down speed control signal delivered out of the optimal control unit 28 are supplied to the press-down apparatus 14b–14d.

The delivered strip thicknesses out of the respective mill stands 12a–12e may be detected by thickness detectors provided for the respective stands according to the gauge meter method, but in this embodiment the delivered strip thicknesses are obtained by using the principle of constant volume velocity, that is, the fact that the incoming and the delivered volume velocities of strip are the same for each stand, so as to eliminate influences by the wear in the work rolls, thermal expansion, the errors in the zero points of the press-down positions and the eccentricities of the rolls. Namely, let the incoming strip thickness, the incoming strip velocity, the delivered strip thickness and the delivered strip velocity with respect to the i-th stand be denoted respectively by $H_i$, $V_i$, $h_i$ and $v_i$. Then, it follows that $$H_iV_i = h_iv_i \tag{16}$$

where it is assumed that the incoming strip velocity $V_i$ at the i-th stand is equal to the delivered strip velocity $v_{i-1}$ at the (i-1)th stand.

The delivered strip velocity $v_i$ is given by the following expression.

$$v_i = v_{Ri}(1+f_i) \tag{17}$$

Here, $v_{Ri}$ is the peripheral speed of the work roll and $f_i$ is the factor of advance.

The factor of advance $f_i$ can be expressed as follows, as revealed by experiments.

$$\begin{aligned} f_i &= ar_1 - b(t_i - t_{i-1}) \\ &= a\left(1 - \frac{h_i}{H_i}\right) - b(t_1 - t_{i-1}) \end{aligned} \tag{18}$$

Here, a is determined by a function of the incoming strip thickness $H_i$ to the i-th stand, the incoming strip thickness to the initial mill stand and tension; b is determined by a function of the incoming strip thicknesses to the i-th and initial stands; $r_i$ the press-down rate of the i-th stand; $t_i$ and $t_{i-1}$ the forward and backward tensions at the i-th stand, the backward tension $t_{pi-1}$ being equal to the forward tension at the (i−1) stand.

From the expressions (16) and (17), the incoming strip thickness $H_i$ is related to the delivered strip thickness $h_i$ as follows.

$$h_i = H_i\frac{v_{Ri-1}(1+f_{i-1})}{v_{Ri}(1+f_1)} \tag{19}$$

Here, the factors of advance $f_i$ and $f_{i-1}$ for the i-th and (i−1)th stands may be obtained in three ways as follows. According to the first method, the factors of advances $f_i$ and $f_{i-1}$ are regarded as constants and obtained through calculation from the press-down amount and the kind of steel used at the time of drafting the rolling schedule. According to the second method, the value $\bar{f}_i$ (or $\bar{f}_{i-1}$) obtained by the first method is corrected by the strip thickness deviation and the tension deviation. The second method is formulated as follows.

$$f'_i = \bar{f}_i + (\partial f/\partial H)_i\cdot\Delta H_i + (\partial f/\partial t_f)_i\cdot\Delta t_{pi} + (\partial f/\partial t_b)_i\cdot\Delta t_{pi-1} \tag{20}$$

where $(\partial f/\partial H)_i$, $(\partial f/\partial t_f)_i$ and $(\partial f/\partial t_b)_i$ are the coefficients of $\Delta H_i$, $\Delta t_{pi}$ and $\Delta t_{pi-1}$, respectively. Namely, the virtual factor $f'_i$ is obtained from the expression (20), the virtual delivered strip thickness $h'_i$ is calculated by substituting $f'_i$ into the expression (19), and the factor $f_i$ is obtained by using $f'_i$ and $h'_i$ in accordance with the following expression.

$$f_i = f'_i + (\partial f/\partial h)_i\cdot(h'_i - \bar{h}_i) \tag{21}$$

where $(\partial f/\partial h)_i$ is a coefficient and $\bar{h}_i$ is a desired strip thickness. The present invention used the second method.

The third method leads to the solution of the equation (19) on the assumption that the expression (19) is a function of $h_i$. By substituting the expressions (17) and (18) into the expression (16), it follows that $$h_i = \frac{H_i}{2a}\left[Y_i - \sqrt{Y_i^2 - 4a\left(\frac{v_{Ri-1}}{v_{Ri}}\right)\left\{Y_{i-1} - a\left(\frac{h_{i-1}}{H_{i-1}}\right)\right\}}\right] \tag{22}$$

where $Y_i = 1 + a + b(t_i - t_{i-1})$.

According to the embodiment, the thickness detectors 18a and 18b are provided at the incoming and delivery sides of the first stand 12a, the roll speeds at the respective stands and the interstand tensions are detected, the delivered strip thicknesses out of the respective stands are calculated in accordance with the formulae (19), (20), (21), and the deviation of the thicknesses from desired values and the factor of advance are obtained. Such calculations are completed by the delivered strip thickness deviation calculating unit 22 every sampling period T of, for example, 20 milliseconds. According to this invention, as the incoming strip thickness $H_i$ in (19) is used the delivered strip thickness obtained through calculation for the (i−1) stand, delayed by a time required for the strip to transfer from one stand to another by the use of the memory unit 24. The factor of advance $f_i$ as output from the unit 24 is used for determining such transfer time.

Now, the operation of the system as an embodiment of the present invention. The system shown in FIG. 2 operates in the mode of shape control and controls the strip thickness by controlling the press-down speeds of the work rolls of the second to fourth stands and the forward tensions with respect to the first and fourth stand. Accordingly, in the experiments (7)–(15), it follows that $\eta_{s1}=0$, $\eta_{s2}=\eta_{s3}=\eta_{s4}=1$, $\eta_{t1}=\eta_{t4}=1$, and $\eta_{t2}=\eta_{t3}=0$, and the respective control amounts are given by the following expressions.

$$\begin{aligned} v_{s2} = \frac{1}{\left(\frac{\partial h}{\partial s}\right)_2\left\{4\left(\frac{\partial h}{\partial t_f}\right)_1^2 + \left(\frac{\partial h}{\partial t_b}\right)_2^2\right\}} & \left[\frac{6}{T}\left(\frac{\partial h}{\partial t_b}\right)_2\left\{\left(\frac{\partial h}{\partial t_b}\right)_2\Delta h_1(kT) - \right.\right. \\ & \left.\left(\frac{\partial h}{\partial t_f}\right)_1\Delta h_2(kT)\right\} + 3\left(\frac{\partial h}{\partial t_f}\right)_1\left(\frac{\partial h}{\partial t_b}\right)_2\left(\frac{\partial h}{\partial H}\right)_1\left(\frac{\partial H}{\partial \tau}\right)_1 - \\ & \left.\left\{4\left(\frac{\partial h}{\partial t_f}\right)_1^2 + \left(\frac{\partial h}{\partial t_b}\right)_2^2\right\}\left(\frac{\partial h}{\partial H}\right)_2\left(\frac{\partial H}{\partial \tau}\right)_3\right] \end{aligned} \tag{23}$$

$$v_{s3} = -\frac{1}{\left(\frac{\partial h}{\partial s}\right)_3}\left[\frac{3}{2T}\Delta h_3(kT) + \left(\frac{\partial h}{\partial H}\right)_3\left(\frac{\partial H}{\partial \tau}\right)_3\right] \tag{24}$$

$$\begin{aligned} v_{s4} = -\frac{1}{\left(\frac{\partial h}{\partial s}\right)_4}\,\frac{1}{\left\{\left(\frac{\partial h}{\partial t_f}\right)_4^2 + 4\left(\frac{\partial h}{\partial t_b}\right)_5^2\right\}} & \left[\frac{6}{T}\left(\frac{\partial h}{\partial t_b}\right)_5\left\{\left(\frac{\partial h}{\partial t_b}\right)_5\Delta h_4(kT) - \right.\right. \\ & \left.\left(\frac{\partial h}{\partial t_f}\right)_4\Delta h_5(kT)\right\} + \left(\frac{\partial h}{\partial H}\right)_4\left\{\left(\frac{\partial h}{\partial t_f}\right)_4^2 + \right. \\ & \left.4\left(\frac{\partial h}{\partial t_b}\right)_5^2\right\}\left(\frac{\partial H}{\partial \tau}\right)_4 - \\ & \left.3\left(\frac{\partial h}{\partial t_4}\right)_4\left(\frac{\partial h}{\partial t_b}\right)_5\left(\frac{\partial h}{\partial H}\right)_5\left(\frac{\partial H}{\partial \tau}\right)_5\right] \end{aligned} \tag{25}$$

$$\Delta t_1 = \frac{-1}{\left\{4\left(\frac{\partial h}{\partial t_f}\right)_1^2 + \left(\frac{\partial h}{\partial t_b}\right)_2^2\right\}}\left[4\left(\frac{\partial h}{\partial t_f}\right)_1\Delta h_1(kT) + \right. \tag{26}$$

-continued $$\Delta t_4 = \frac{2T(\frac{\partial h}{\partial t_f})_1(\frac{\partial h}{\partial H})(\frac{\partial H}{\partial \tau})_1 + (\frac{\partial h}{\partial t_b})_2 \Delta h_2(kT)]}{\{(\frac{\partial h}{\partial t_f})_4^2 + 4(\frac{\partial h}{\partial t_b})_5^2\}} \frac{-1}{}[(\frac{\partial h}{\partial t_f})_4 \Delta h_4(kT) + 4(\frac{\partial h}{\partial t_b})_5 \Delta h_5(kT) + 2T(\frac{\partial h}{\partial t_b})_5(\frac{\partial h}{\partial H})_5(\frac{\partial H}{\partial \tau})_5] \quad (27)$$

The calculations according to the expressions (23)–(27) are repeated by the optimal control unit 28 every sampling period and the optimal control unit 28 delivers the control signals $\Delta t_{p1}$, $\Delta t_{p4}$, $v_{s2}$, $v_{s3}$ and $v_{s4}$ every sampling period. Since in this embodiment the control mode is of shape control, the last stand 12*e* having the greatest influence on the shape of product is not directly controlled.

Figure 3:
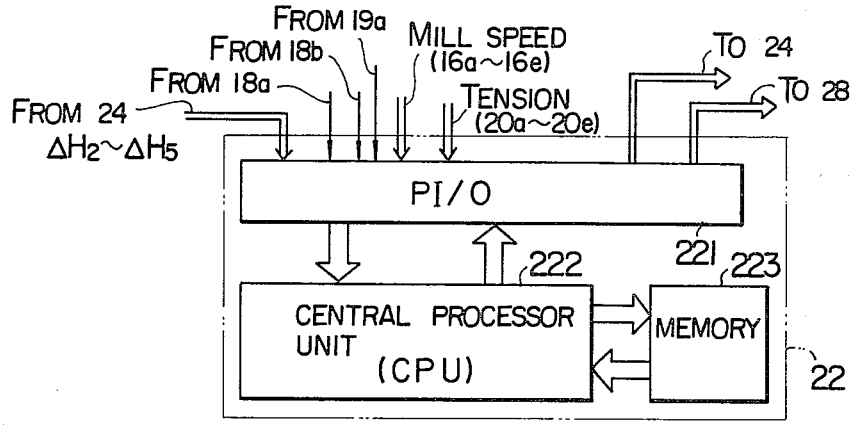
FIG. 3 is a block diagram illustrating a typical hardware arrangement of a delivered strip thickness deviation calculating unit 22 shown in FIG. 2.

Next, a detailed description will be made on the functions or operations of the individual units employed in the apparatus shown in FIG. 2 by referring to FIGS. 3 to 12. In FIG. 2, each of the delivered strip thickness deviation calculating unit 22, the arithmetic unit 26, the optimal control unit 28 and the coefficient calculating unit 36 are constituted, respectively, by a computer. The memory unit 24 also includes a computer with a view to making the operation time thereof variable in accordance with the rolling speed. Of course, it is possible to execute all the functions of these units 22, 24, 26, 28 and 36 by means of a single computer. However, it is preferred that these units are constituted by separate micro-computers in order to enhance the processing speed. Referring to FIG. 3 which shows a hardware implementation of the delivered strip thickness deviation calculating unit 22, this unit is constituted by a computer including a process input/output device (PI/O) 221 for transferring input and output signals with other computers, a central processing unit or CPU 222 for arithmetically determining process quantities from the input signals fetched in the computer and data previously stored in an associated memory in accordance with a stored program and a memory unit 223 for storing data and program. When the input signal is of an analog quantity, the process input/output device 221 serves to convert the input signal level to the level compatible with the processing in CPU and then perform analog-to-digital conversion, the resulting digital signal being supplied to CPU 222. The primary function of the calculating unit 22 is to determine arithmetically the strip thickness deviation and the factor of advance. The operations of this unit 22 is illustrated in the flow chart of FIG. 8. At the step F1, it is decided whether the rolling operation is being performed. If affirmative, program steps F3 to F25 are executed. Decision at the step F1 is effected in practice by using a load detector 19*a*. When the output P from the load detector 19*a* exceeds a reference value $P_o$, it is determined that the rolling work is being conducted. In a typical case, the reference value $P_o$ is selected to be substantially equal to a half of P, i.e. $P_o \simeq \frac{1}{2} \cdot P$. When affirmative decision is made at the step F1, the program routine proceeds to the step F3 at which the mill stand identifying number i is set to 1 (i.e. i=1) in order to initiate the arithmetic operations starting from the first mill stand. At the step F5, various physical quantities such as $\Delta H1$, $\Delta h1$, $v_{R1}$, . . . , $v_{R5}$, $t_{p1}$, . . . , $t_{p4}$ which are required for the arithmetic operations or calculations in CPU are fetched in response to the sampling timing signal described hereinafter. At the step F7, CPU fetches therein data $\Delta H_2$, . . . , $\Delta H_5$ from the memory unit 24. The loading of these physical quantities to CPU is of course effected through the input/output device 221. At the succeeding step 9, the calculation is executed on the basis of the input physical quantities in accordance with the equation (20) to determine a provisional factor of advance $f_i'$. At the step F11, the arithmetic operation according to the equation (19) is executed by using the calculated value of $f_1'$ thereby to determine $h_i'$. At the step F13, arithmetic operation in accordance with the equation 21 is executed by using the calculated values of $h_i'$ and $f_i'$ to obtain the factor of advance $f_i$. At the step F15, arithmetic operation for the equation (19) is executed on the basis of the determined factor of advance $f_i$, thereby to calculate the delivered strip thickness $h_i$ and additionally determine the difference between the calculated thickness $h_i$ and the desired delivered thickness $\bar{h}_i$, that is, the thickness deviation $\Delta h_i$. At the step F17, it is decided whether the arithmetic operations described above have been executed for all of the mill stands. In the case of the illustrated embodiment, it is assumed that the rolling mill includes five mill stands in tandem. Accordingly, this decision can be realized by checking if i=5. If the decision is negative at the step F17, the program proceeds to the step F19 where the arithmetic operation i=i+1 is executed and returns to the step F9. When all the calculations (except for the delivered strip thickness deviation $\Delta h_1$ at the first stand which is a detected value) have been completed, the next step F21 is executed, whereby the calculated and/or detected values of $\Delta h_1$ to $\Delta h_4$ as well as $f_i$ to $f_4$ are output to the unit 24. At the step F23, the calculated values of the delivered strip thickness deviations $\Delta h_2$ to $\Delta h_5$ are output to the unit 28. The transfer of these output signals is effected through the process input/output device 221. After the signals having been outputted, the program routine proceeds to the step F25 at which a timer is set to stop the sequence of the arithmetic operations described above until the next sampling is initiated to fetch the output signals from the respective detectors. This timer may be composed of a counter for counting clock pulses for the control of the microcomputer which is adapted to initiate the counting of clock pulses in response to the set signal produced at the step F25 and produce a pulse signal for determining the succeeding sampling timing when the count contents has attained a predetermined number. The sampling period is so selected that a new sampling cycle is started only when the measurement values sampled during the preceding cycle have been processed and the corresponding controls have been performed.

Figure 4:
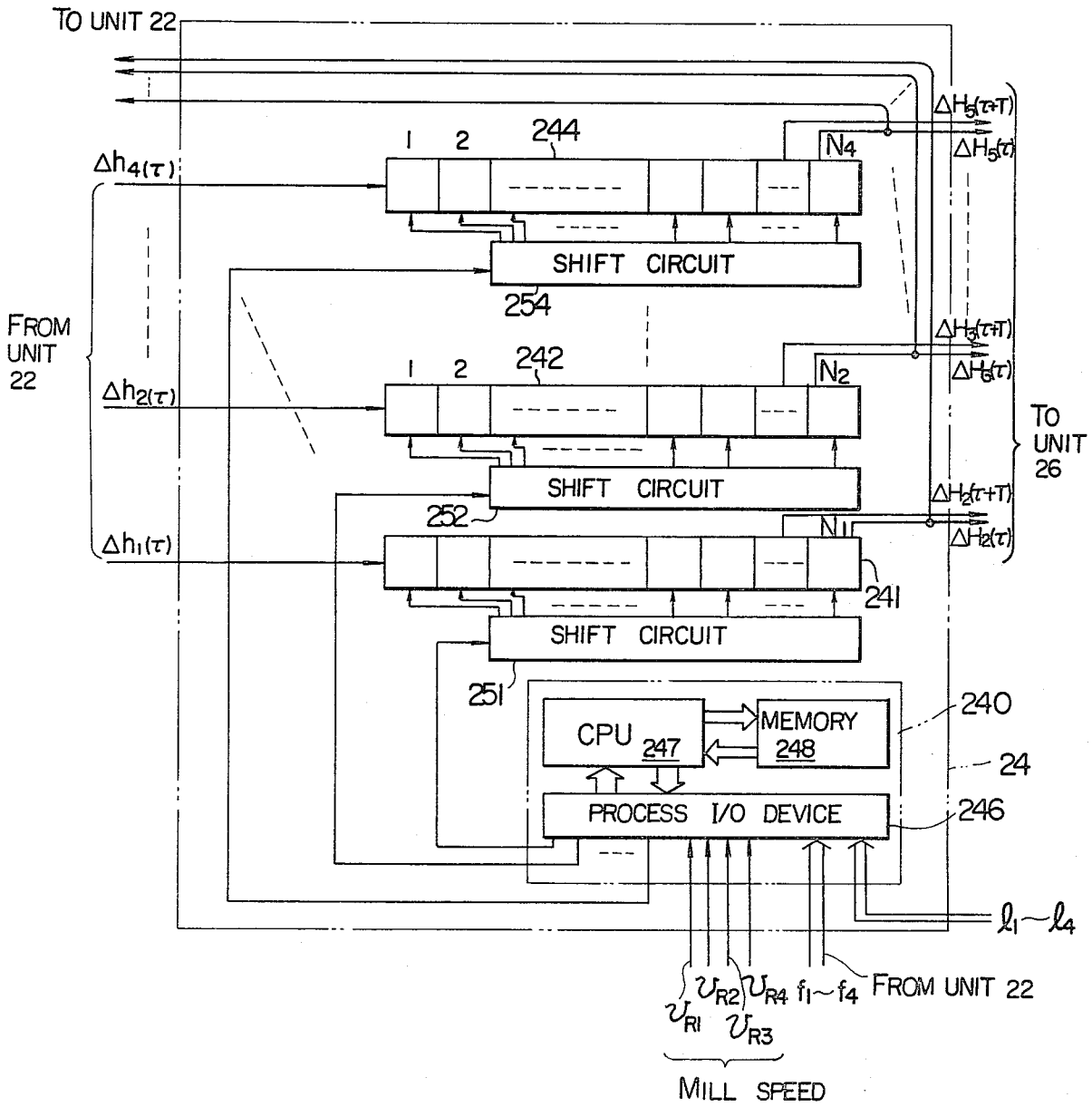
FIG. 4 is a block diagram illustrating an exemplary arrangement of a memory unit 24 shown in FIG. 2.

Next, detailed description will be made on the arrangement and operations of the memory unit 24 shown in FIG. 2. A hardware arrangement of the memory unit 24 is shown in FIG. 4. In this figure, reference numeral 240 denotes a computer for arithmetically determining the gate through which the contents in shift registers is outputted in dependence on the speed of the rolled material. Reference numerals 241 to 244 denote shift registers for fetching therein the delivered strip thickness deviations at the first to fourth mill stands for every sampling period and shifting sequentially the stored contents rightwardly. Numerals 251 to 254 denote shift circuits for controlling the number of shifting steps to be executed on the shift registers 241 to 244, respectively. The computer 240 is composed of process input/output device 246, CPU 247 and memory unit 248 The operations of the computer 240 are illustrated in the flow chart of FIG. 9.

The operation starts with a starting command given when the output of the unit 22 is applied thereto.

At the step F27, the stand identification number i is set to 1, i.e. $i=1$. Next, at the steps F29 and F31, the output signals $v_{R1}$ to $v_{R4}$ from the speed detectors 17*a* to 17*d* as well as the factor of advance $f_1$ to $f_4$ available from the outputs of the unit 22 as required for arithmetic operations are fetched through the input/output interface 246. Distances $l_1$ between the thickness detector 186 at the exit side of the first stand and the second stand, distance $l_2$ between the second and the third stands, distance $l_3$ between the third and the fourth stands, distance $l_4$ between the fourth and the fifth or final stand and the number $N_i$ of unit registers provided in each of the shift registers are previously stored in the memory unit 248 before the starting of the rolling operation. At the step F33, the strip speed $v_i$ at the exit side of each stand is determined by executing arithmetic operation in accordance with the equation $v_i=v_{Ri}(1-+f_i)$. At the step F35, the value $n_i$ indicative of the number of shift steps to be executed on the shift register is calculated according to an equation $n_i=N_i \cdot v_i T/l_i$. In this connection, it is noted that the quotient has to be rounded, if necessary, to obtain an integer for the value of $n_i$. Since the interstand distances are all constant and the sampling period is maintained also constant, value of $n_i$ varies as a function of the speed $v_i$, and become larger as the speed $v_i$ becomes higher. Each of the shift registers 241 to 244 is provided with unit registers 1, 2, 3, . . . Ni and the content of each unit register is shifted to the next unit register in each shifting step.

The number Ni of the unit registers is proportional to the distance $l_i$ between th i-th stand and the (i+1)th stand. For example, if one unit register is allotted to every 10 cm span in the stand-to-stand distance, and the distance between the first and the second stand is 5 m, then the shift register 241 is provided with $Ni=50$ unit registers. The shift register is arranged to output the contents of the last two unit registers, that is, the right-most two unit registers in the illustrated shift register. These contents are indicative of successive incoming strip thickness deviations $\Delta H_i(\tau)$ and $\Delta H_i(\tau+T)$ and applied to the arithmetic unit 26 for calculating the rate of change in unit time of the incoming strip thickness deviation. At the step F43, the value $n_i$ calculated at the step F35 is applied to the corresponding one of the shift registers 251 to 254 thereby shifting the content of each unit register to the next $n_i$-th unit register. As a result, the contents of the shift register are shifted successively at a rate corresponding to the exit strip speed at the associated stand. At the step F39, it is decided by testing the value of i whether computations have been completed for all of the interstand spaces. Since there exist four interstand spaces, the operation is temporarily ended when $i=4$ until the next starting command is given. On the other hand, if $i<4$, this means that the arithmetic operations for all the interstand spaces have not yet been completed. In this case, the routine will proceed to the step F41 where the operation $i=i+1$ is executed and returns to the step F33 for repeating the above described operations.

The values $N_i$ derived from the computer 240 are fed to the shift circuits 251 to 254 thereby shifting the contents of the associated shift registers 241 to 244 successively to the right side therein. As a result, the contents of the right-most two unit registers in each shift register represent the incoming strip thickness deviations $\Delta H_i(\tau)$ and $\Delta H_i(\tau+T)$ at the time points $\tau$ and $\tau+T$, respectively, for the i-th stand ($i=2$–5). Both of these deviations are fed to the arithmetic unit 26 from the memory unit 24. Fed to the delivered strip thickness deviation calculating unit 22 are only the incoming strip thickness deviations $\Delta H_2(\tau)$ to $\Delta H_5(\tau)$ at the time point $\tau$.

Figure 5:
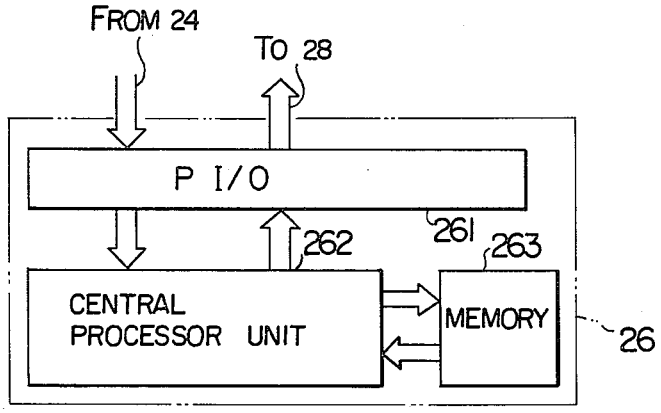
FIG. 5 is a block diagram illustrating a typical arrangement of an arithmetic unit 26 shown in FIG. 2.
Figure 10:
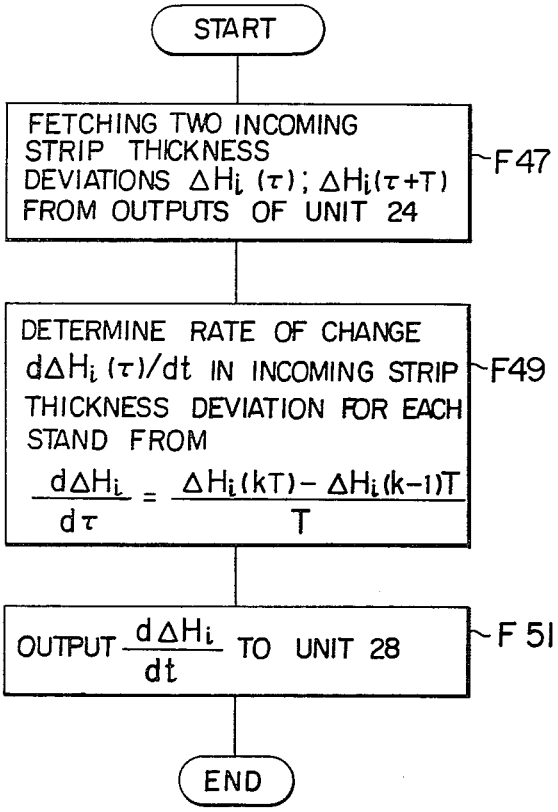
FIG. 10 is a flow chart to illustrate functions executed in the arithmetic unit 26 shown in FIG. 2.
Figure 12:
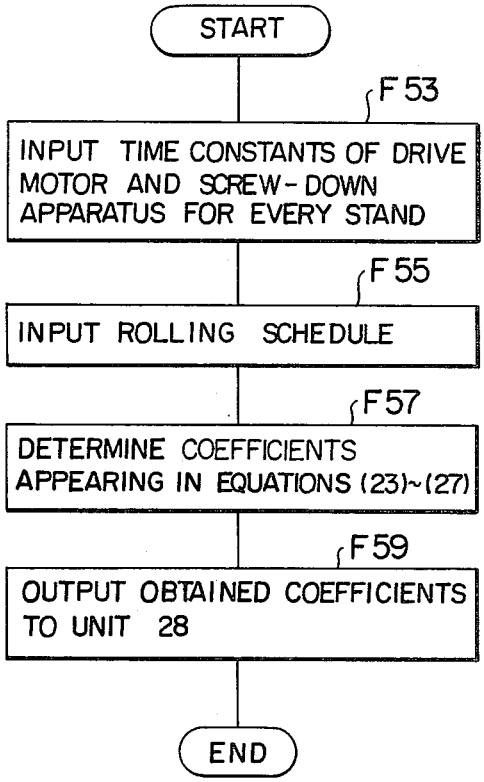
FIG. 12 is a flow chart to illustrate functions executed in the coefficient calculating unit 36 shown in FIG. 2.

Next, the arithmetic unit 26 shown in FIG. 2 will be described in detail in respect of the arrangement and operations by referring to FIGS. 5 and 10. FIG. 5 shows a hardware arrangement of the unit 26 which is constituted by an input/output interface 261 for controlling or conditioning the signals as transferred, a central processing unit or CPU 262 for executing arithmetic operations, and a memory unit 263. FIG. 10 is a flow chart illustrating the operations of the arithmetic unit 26. Referring to FIG. 10, interruption will take place when data $\Delta H_i(\tau)$ and $\Delta H_i(\tau+T)$ are output from the unit 24. These data signals are then fetched and stored in the unit 26 at the step F47. Then, the routine will proceed to the step F49 at which the rate of change of the incoming strip thickness variation $d\Delta H_i/dt$ is arithmetically determined on the basis of the stored data. The rate of change $d\Delta H_i/dt$ as determined is fed to the optimal control unit 28 at the step F51, thereby to terminate the operations. This sequence of operations is performed for every input signal. Since the memory unit 24 produce, output signal for every sampling period T, the arithmetic unit 26 will be also operated for every sampling period.

Figure 7:
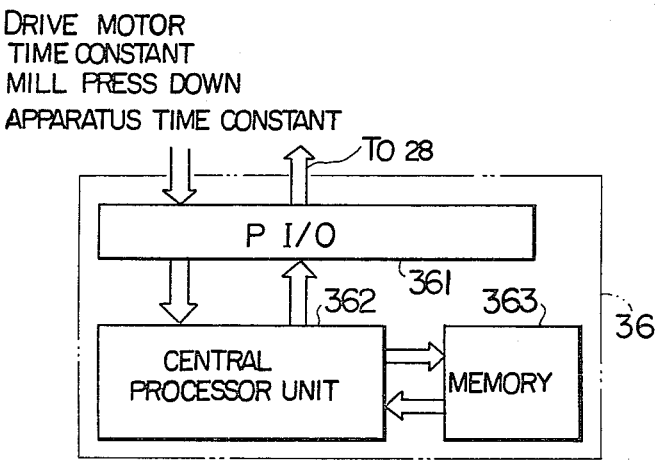
FIG. 7 is a block diagram illustrating an arrangement of a coefficient calculating unit 36 shown in FIG. 2.
Figure 8:
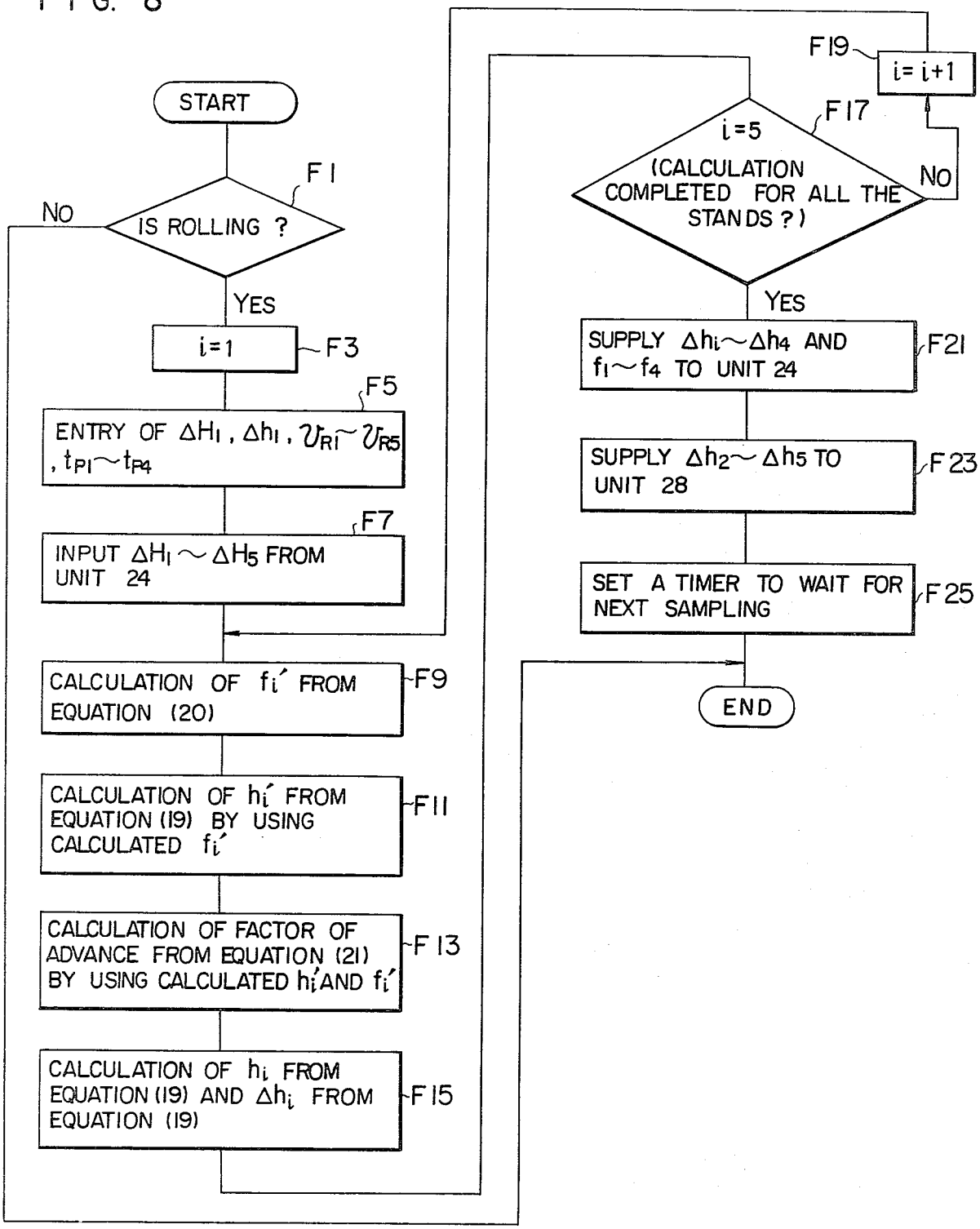
FIG. 8 is a flow chart to illustrate functions performed in the delivered strip thickness deviation calculating unit 22.
Figure 9:
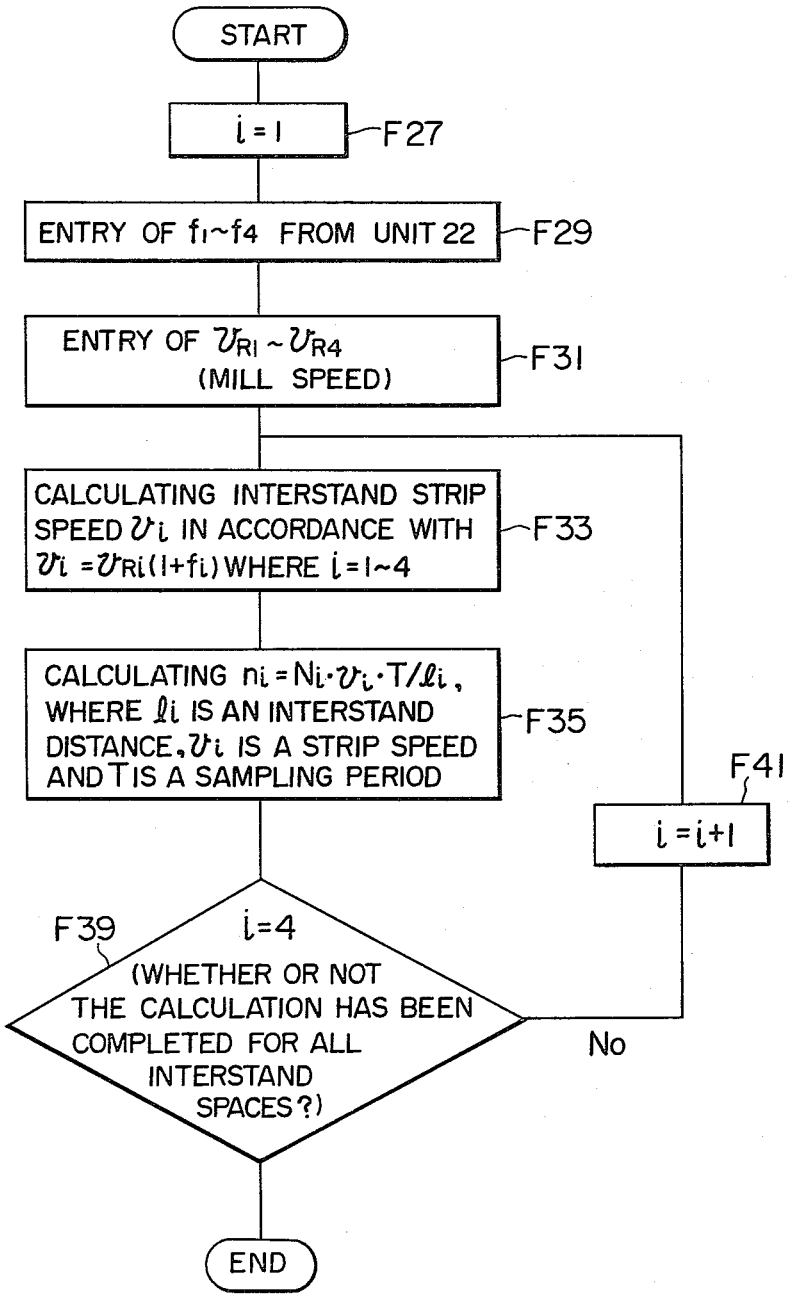
FIG. 9 is a flow chart to illustrate functions executed in the memory unit 24 shown in FIG. 2.

Now, description will be made of the optimal control unit 36 shown in FIG. 2. This unit 26 functions to arithmetically determine the coefficients required for the optimal control unit 28 to arithmetically determine the control signals. The calculation of the coefficients is executed and the results are fed to the optimal control unit before the starting of the rolling operation. The hardware arrangement of the coefficient calculating unit 36 is schematically shown in FIG. 7, while the operations thereof are illustrated in the flow chart of FIG. 12. At the steps F53 and F55, time constants of the drive motors 16*a* to 16*e*, time constants of the screw-down or press-down apparatus 14*a* to 14*e* and the rolling schedule which are required for arithmetic determination of the coefficients are input to the unit 36. At the step F57, the coefficients (partial differential coefficient) required for realizing the equations (23) to (27) are arithmetically determined. At the step F59, the obtained coefficients are fed to the optimal control unit 28.

Figure 6:
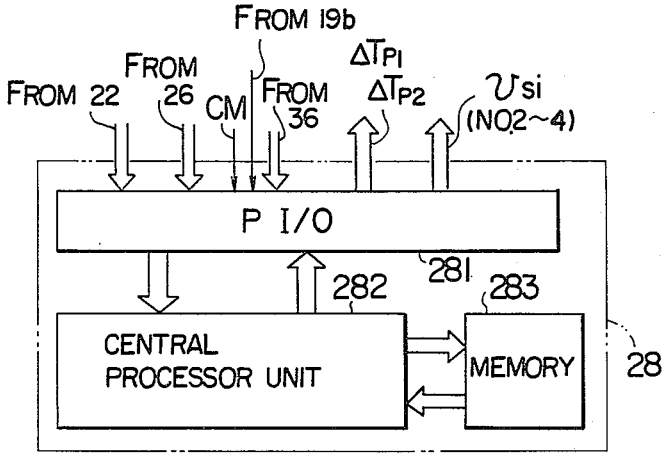
FIG. 6 is a block diagram to illustrate an exemplary arrangement of an optimal control unit 28 shown in FIG. 2.
Figure 11:
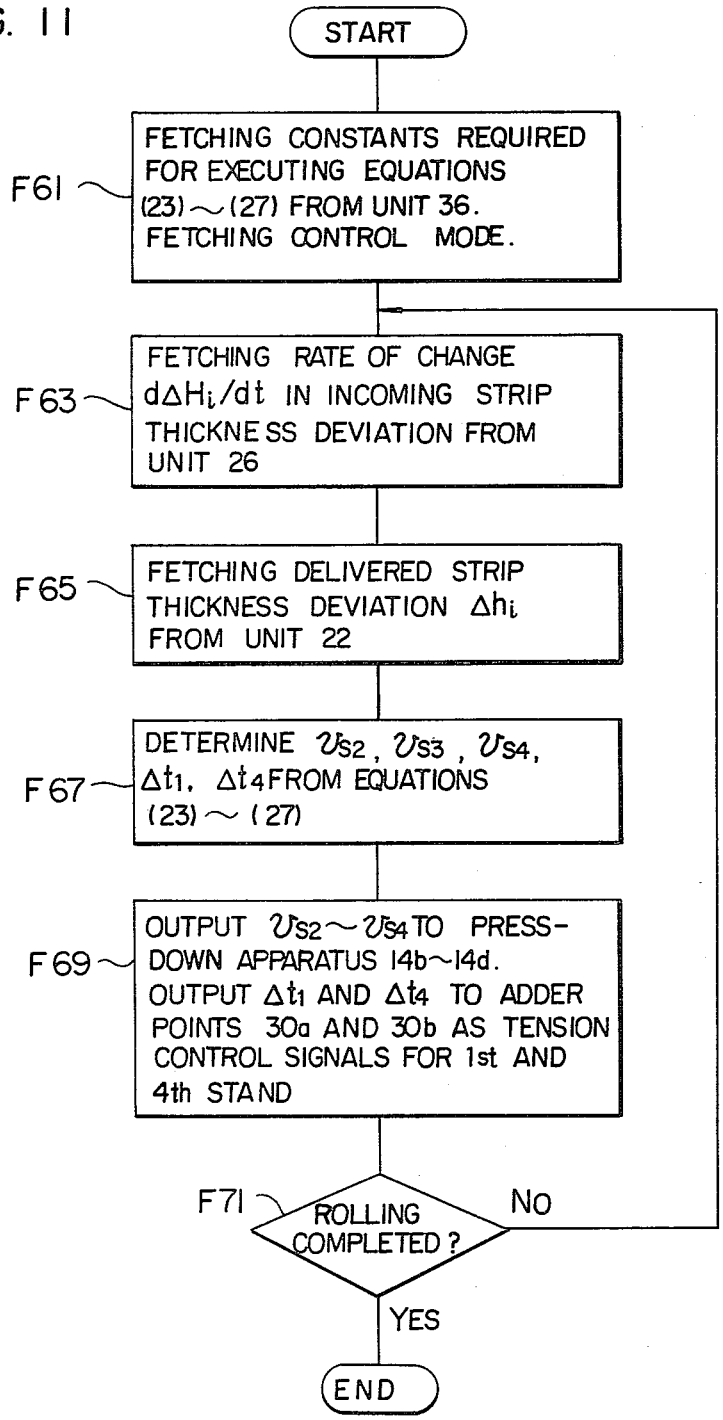
FIG. 11 is a flow chart to illustrate functions executed in the optimal control unit 28 shown in FIG. 2.

Finally, a hardware arrangement as well as operations of the optimal control unit 28 will be described in detail. The arrangement of the optimal control unit 28 is shown in FIG. 2, while the operations thereof are illustrated in the flow chart of FIG. 11. In FIG. 6, reference numeral 281 denotes an input/output interface for fetching input signals into CPU and supplying the results of the arithmetic operations (control signals) from CPU to the associated operating apparatus. To this end, the input/output interface 281 includes digital-to-analog converters for converting the resulting signals from the arithmetic operations of CPU to corresponding analog quantities and amplifiers for amplifying the analog quantities to levels for actuating the operating members or apparatus. In other words, the output signals from the optimal control unit 28 constitute the control signal for the various operating components of the rolling mill. CPU 282 serves to arithmetically determine the optimal control quantities on the basis of the input data and various coefficients previously stored in a memory unit 283. Referring to FIG. 11, the unit 28 executes operations defined at the steps F63 to F71 everytime when the output signals from the arithmetic unit 26 and the delivered strip thickness deviation calculating unit 22 are fed to the unit 28. At the step 61, the output signal from the coefficient calculating unit 36 as well as control mode signal CM are stored before the starting of the rolling operation. At the steps F63 and F65, signals are fetched from the units 26 and 22. Subsequently, at the step F67, the control signals $v_{s2}$, $v_{s3}$, $v_{s4}$, $\Delta t_1$ and $\Delta t_4$ (in the form of digital quantities) are produced by realizing the equations (23) to (27). At the step F69, the control signals $v_{s2}$ to $v_{s4}$ for the press-down speeds of the screw-down apparatus for the second to the fourth stands are fed to the units 14*b* to 14*d*, respectively. Additionally, tension control signals $\Delta t_1$ and $\Delta t_4$ for the first and the fourth stands are outputted at the adder or summing points 30*a* and 30*b*, respectively. The transfer of these signals are effected through the input/output interface 281. Thereafter, the process proceeds to the step F71 at which decision is made whether the rolling operation has been completed. If affirmative, the process is terminated. If negative, the system waits for the next input signals, whereupon the steps F63 to F71 are repeated. These operations are repeated until the completion of the rolling operation for every sampling period. The decision at the step F71 as to whether the rolling operation has been completed is made by detecting if the output from the load detector 19*b* exceeds the reference value. It is determined that the rolling operation still continues when the detector output exceeds the reference value.

Referring again to FIG. 2, in the case of the first stand 12*a*, a feedback control is performed by actuating the screw-down apparatus 14*a* through the output signal from the thickness detector 18*b* disposed at the exit side.

The press-down controls for the second to the fourth stands are not effected through the control of the press-down positions but through the control of the press-down speeds. This is because the thickness variation in the strip being rolled takes place rather continuously and thus the press-down speed control in proportional dependence on the thickness variation is more suitable for cancelling out such variations. In the modern hydraulic screw-down apparatus in which the press-down speed is significantly increased, the speed control is preferred by virtue of simplified features such that the control is effected merely through the control of hydraulic pressure. Although the invention can be applied to the case in which the press-down position is controlled, the thickness control accuracy will be then more or less degraded, since the response is subjected to some delay due to the fact that the press-down position is determined as the integral of the screw-down speed.

In the illustrated embodiment shown in FIG. 2, the control is based on the combination of the press-down speed and the tension. However, it will be appreciated that the control can be effected only on the basis of the press-down speed or alternatively only on the basis of the tension. In place of the press-down speed control, the press-down position control may be employed. Selection of the control mode depends on the material to be rolled, desired thickness of the finished product, performance characteristics of the rolling mill and the like factors. Such selection can be made empirically in consideration of given conditions described above.

For another control mode where only the press-down speeds of the work rolls of the second and fifth stands are controlled, that is, $\eta_{s1}=0$, $\eta_{s2}=\eta_{s3}=\eta_{s4}=\eta_{s5}=1$ and $\eta_{t1}=0$, the press-down speeds for the respective stands are as follows.

$$v_{s1} = -\frac{1}{\left(\frac{\partial h}{\partial s}\right)_1}\left\{\frac{3}{2T}\Delta h_1(kT) + \left(\frac{\partial h}{\partial H}\right)_1\left(\frac{\partial H}{\partial \tau}\right)_1\right\} \tag{28}$$

$$v_{s2} = -\frac{1}{\left(\frac{\partial h}{\partial s}\right)_2}\left\{\frac{3}{2T}\Delta h_2(kT) + \left(\frac{\partial h}{\partial H}\right)_2\left(\frac{\partial H}{\partial \tau}\right)_2\right\} \tag{29}$$

$$v_{s3} = -\frac{1}{\left(\frac{\partial h}{\partial s}\right)_3}\left\{\frac{3}{2T}\Delta h_3(kT) + \left(\frac{\partial h}{\partial H}\right)_3\left(\frac{\partial H}{\partial \tau}\right)_3\right\} \tag{30}$$

$$v_{s4} = -\frac{1}{\left(\frac{\partial h}{\partial s}\right)_4}\left\{\frac{3}{2T}\Delta h_4(kT) + \left(\frac{\partial h}{\partial H}\right)_4\left(\frac{\partial H}{\partial \tau}\right)_4\right\} \tag{31}$$

$$v_{s5} = -\frac{1}{\left(\frac{\partial h}{\partial s}\right)_5}\left\{\frac{3}{2T}\Delta h_5(kT) + \left(\frac{\partial h}{\partial H}\right)_5\left(\frac{\partial H}{\partial \tau}\right)_5\right\} \tag{32}$$

In fact, since the press-down speed $v_s$, the tension $\Delta t_p$, etc. can be controlled as control variables, the control of strip thickness can be freely performed by arbitrarily selecting control variables, that is, by arbitrarily selecting independent variables in the above expressions (7)-(15).

As described above, according to the present invention, the change in the strip thickness is considered within the sampling period or interval by using two sampling values for the incoming strip thickness and the control system is so constructed as to minimize the strip thickness deviation in the period. Consequently, the control of strip thickness according to the present invention has a very higher accuracy than according to the conventional control method and system. According to the control method and system embodying the present invention, the amount of the off-gauge portions is almost half that according to the conventional method and system. In this respect, the present invention can be said to have provided a great inventive step.

Moreover, according to the present invention, the control can be freely changed by suitably selecting control modes in accordance with the shapes of work rolls and the materials of strip and therefore the optimal rolling control can be performed and the present invention can be applied usefully to various rolling mills.

I claim:

1. A system for minimizing deviations in the delivered strip thickness in a tandem rolling mill, comprising:

means for sampling one of thicknesses and thickness deviations of the strip at the entry and delivery sides of each rolling stand of the tandem mill during rolling operation with a predetermined sampling period;

a calculating unit for determining the time rate of change of the incoming thickness of the strip at each rolling stand as a function of the sampled values thereof and the sampling period;

an optimal control unit receiving the outputs of said sampling means and said calculating unit for determining an optimal value of a control parameter for mill operation effective to control the delivery thickness of the strip at each rolling stand, the optimal value satisfying a predetermined evaluating function which is a function of at lease one of the time rate of change of the incoming thickness, the delivery thickness and thickness deviation of the strip at each rolling stand, and said control parameter; and means for controlling the mill operation on the basis of said optimal value determined for each rolling stand.

2. A system as claimed in claim 1, wherein said evaluating function includes at least one of the sum of the squares of the delivered strip thickness deviations, the interstand tension deviations, the changes in the press-down positions, and the changes in the press-down speeds.

3. A system as claimed in claim 1 or 2, wherein said optimal control unit is so constructed as to select as said control variables at least one of the press-down position, the press-down speed and the interstand tension for each mill stand in accordance with a previously determined control mode signal.

4. A system as claimed in claim 1 or 2, wherein said sampling means comprises means for detecting one of the delivery thickness and thickness deviation of the strip at the delivery side of each rolling stand, and means for storing the detected value thereof for a period of time required for the strip to move from said each rolling stand to the next rolling stand and then outputting said value, as a value of one of the incoming strip thickness and thickness deviation at the next rolling stand.

5. A system as claimed in claim 1 or 2, wherein said calculating unit determines said time rate of change of the thickness of the strip as a ratio of the difference between successive two of said sampled values of one of the incoming strip thicknesses and the thickness deviations.

6. A system as claimed in claim 4, wherein said detecting means comprises a thickness detector provided at the delivery side of a selected one of the rolling stands of the mill, means for detecting the rolling speed at each rolling stand and means for calculating the delivery strip thickness at each rolling stand other than said selected one on the basis of the principle that the volume velocities at the entry and delivery sides of each rolling stand are equal to each other.

7. A system for minimizing deviations in the delivered strip thickness in a tandem rolling mill comprising:

means for sampling one of thicknesses and thickness deviations of the strip at the entry and delivery sides of a respective mill stand of the tandem rolling mill during rolling operation with a predetermined sampling period;

means for determining the time rate of change of the incoming thickness of the strip at respective mill stands as a function of the sampled values thereof and the sampling period;

means for obtaining optimal values of control variables at respective mill stands in response to the time rate of change of thickness of the strip, the values being obtained for satisfying a predetermined evaluating function; and means for controlling the tandem rolling mill in response to the optimal values obtained so as to maintain the optimal values and minimize deviations in the delivered strip thickness.

8. A method for controlling the strip thickness out of a tandem rolling mill to a desired value, comprising the steps of:

sampling one of thicknesses and thickness deviations of the strip at the entry and delivery sides of a respective mill stand of the tandem rolling mill during rolling operation with a predetermined sampling period and generating electrical signals in accordance therewith;

determining the time rate of change of the incoming thickness of the strip at respective mill stands as a function of the generated electrical signals of the sampled values thereof and the sampling period and generating electrical signals in accordance therewith;

obtaining optimal values of control variables at respective mill stands in response to the generated electrical signals of the time rate of change of thickness of the strip and generating electrical signals in accordance therewith, the values being obtained for satisfying a predetermined evaluating function; and automatically controlling the tandem rolling mill in response to the generated electrical signals of the optimal values obtained so as to maintain the optimal values and minimize deviations in the delivered strip thickness.

9. A method for controlling the strip thickness in a tandem rolling mill, as claimed in claim 8, wherein the step of obtaining optimal values includes utilizing said evaluating function which is a definite integral over a sampling period of the sum of the squares of said deviations of said delivered strip thicknesses obtained from the changes in said incoming strip thicknesses.

10. A method for controlling the strip thickness in a tandem rolling mill, as claimed in claim 8, wherein the step of obtaining optimal values of control variables includes selecting at least one of the tension and press-down speed as control variables and the step of automatically controlling includes controlling at least one of said tension and press-down speed for each mill stand.

11. A method for controlling the strip thickness in a tandem rolling mill, as claimed in claim 8, wherein the step of sampling includes obtaining the incoming strip thickness at the second and the following stands in accordance with the relation of constant mass flow, by using the output of a thickness detector provided at the entry side of the first stand and the velocities of the strip at the respective stand, and the step of determining changes with time in the incoming strip thicknesses at said respective stands includes using the above obtained incoming strip thickness.

12. A method for controlling the strip thickness in a tandem rolling mill, as claimed in claim 11, wherein the step of sampling includes utilizing the work roll speeds at the respective stands corrected by using a factor of advance as the incoming speeds of the strip at said respective stands.

13. A method for controlling the strip thickness in a tandem rolling mill, as claimed in claim 8, wherein the step of determining said changes with time in the incoming strip thicknesses includes detecting one of the incoming strip thicknesses and the incoming strip thickness deviations at the respective stands every predetermined sampling period, calculating the difference between one of two incoming strip thicknesses and two thickness deviations detected during two sampling periods, and dividing said difference by said sampling period.

* * * * *